US007472506B2

(12) United States Patent
Lapointe

(10) Patent No.: US 7,472,506 B2
(45) Date of Patent: Jan. 6, 2009

(54) LIGHTED SIGN

(76) Inventor: Guy Lapointe, 298 rue Lottinville, Trois-Rivières, Québec (CA) G8V 1M9

( * ) Notice: Subject to any disclaimer, the term of this patent is extended or adjusted under 35 U.S.C. 154(b) by 0 days.

(21) Appl. No.: 11/677,834

(22) Filed: Feb. 22, 2007

(65) Prior Publication Data

US 2007/0227055 A1 Oct. 4, 2007

(51) Int. Cl.
*G09F 13/00* (2006.01)

(52) U.S. Cl. ..... 40/541; 40/563; 40/564; 362/812; 362/359

(58) Field of Classification Search ..... 40/563, 40/541, 552, 564, 714, 716; 362/812, 361, 362/359

See application file for complete search history.

(56) References Cited

U.S. PATENT DOCUMENTS 2,022,684 A * 12/1935 Miller ..... 40/563
2,072,986 A * 3/1937 Hotchner ..... 40/545
2,623,315 A * 12/1952 Owen et al. ..... 40/552
2,651,864 A 9/1953 Howenstine
2,651,865 A * 9/1953 Howenstine ..... 40/546
2,729,008 A 1/1956 Van den Berg
3,017,712 A 1/1962 Sherron
3,201,881 A 8/1965 Dechar
3,270,451 A 9/1966 Bartleson et al.
3,318,032 A 5/1967 Robison et al.
3,957,351 A 5/1976 Stockwell
4,140,405 A * 2/1979 Shapiro et al. ..... 40/552
4,410,932 A * 10/1983 Oster ..... 362/294
4,549,252 A 10/1985 Ripley et al.
4,559,731 A 12/1985 Frois et al.
4,922,384 A 5/1990 Torrence
5,283,723 A * 2/1994 Wu ..... 362/147
5,555,654 A 9/1996 Hermann
5,897,201 A 4/1999 Simon
5,975,724 A * 11/1999 Pallanes ..... 362/310

* cited by examiner

*Primary Examiner*—Gary C Hoge
(74) *Attorney, Agent, or Firm*—Ogilvy Renault LLP

(57) ABSTRACT

A lighted sign having a front translucent surface surrounded by a skirt defining an opaque contour. A light diffuser is located behind an opaque zone of the skirt. Light is radiated from an internal light source through the light diffuser to provide an illuminated background for the opaque contour thereby increasing the contrast of the silhouette of the sign on a mounting surface. The front translucent surface is preferably back lit by the same internal source of light.

9 Claims, 2 Drawing Sheets

LIGHTED SIGN

FIELD OF THE INVENTION

The present invention relates to lighted signs and, more particularly, to lighted signs with internal light sources.

SUMMARY OF THE INVENTION

It is an aim of the present invention to enhance the visual aspect of a lighted sign.

In accordance with a general aspect of the present invention, there is provided a lighted sign comprising a front face having at least a translucent portion, a skirt at least partly surrounding said front face and extending rearwardly with respect thereto, said skirt defining a contour of the lighted sign, said contour being at least partly opaque, a light diffuser located behind said skirt, the skirt extending laterally outwardly relative to the light diffuser, and a light source within the lighted sign, the light source lighting both 1) said translucent portion of said front side and 2) the light diffuser, the light transmitted laterally outwardly through the light diffuser backlighting the contour of the skirt.

In accordance with another general aspect, there is provided a lighted sign comprising a housing defining an internal volume housing a light source, said housing having a front face with an opaque contour, said source of light backlighting said front face, a translucent sidewall extending rearwardly relative to said front face, the light from said light source radiating laterally outwardly of said housing though said translucent sidewall to provide an illuminated background for said opaque contour.

In accordance with a still further general aspect, there is provided a lighted sign comprising a housing defining an internal volume for accommodating a light source, said housing having a front face having a main translucent zone surrounded by an opaque zone, the opaque zone defining the outline of the sign, and a sidewall disposed inboard of said outline and extending rearwardly from said front face, said sidewall having a rear translucent portion though which light from said light source can pass to provide a contrasting illuminated background for said outline of the sign.

BRIEF DESCRIPTION OF THE DRAWINGS

Reference will now be made to the accompanying drawings, showing by way of illustration a preferred embodiment thereof, and in which.

DESCRIPTION OF THE PREFERRED EMBODIMENTS

Figure 1:
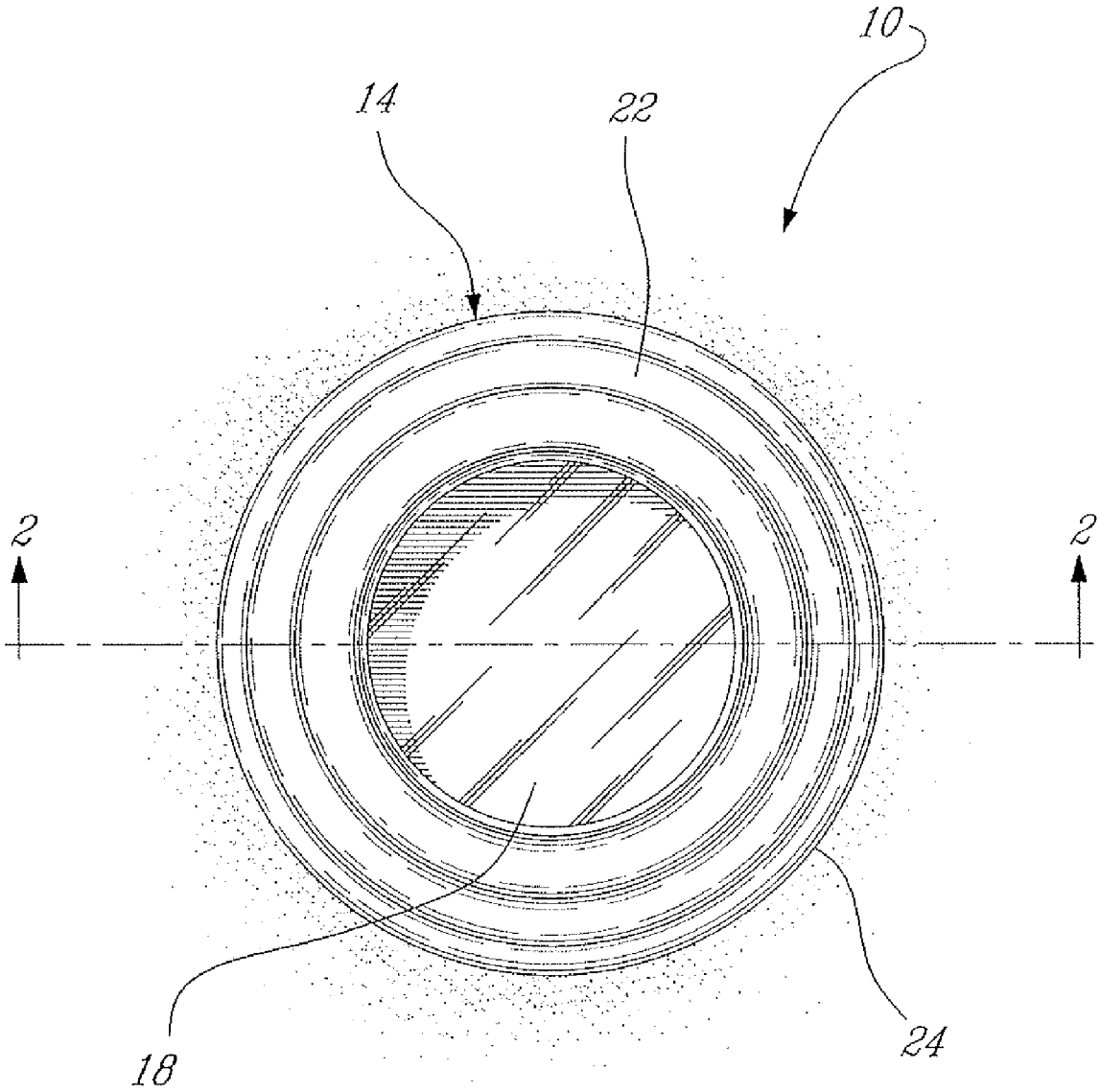
FIG. 1 is a front view of a lighted sign in accordance with an embodiment of the present invention.
Figure 2:
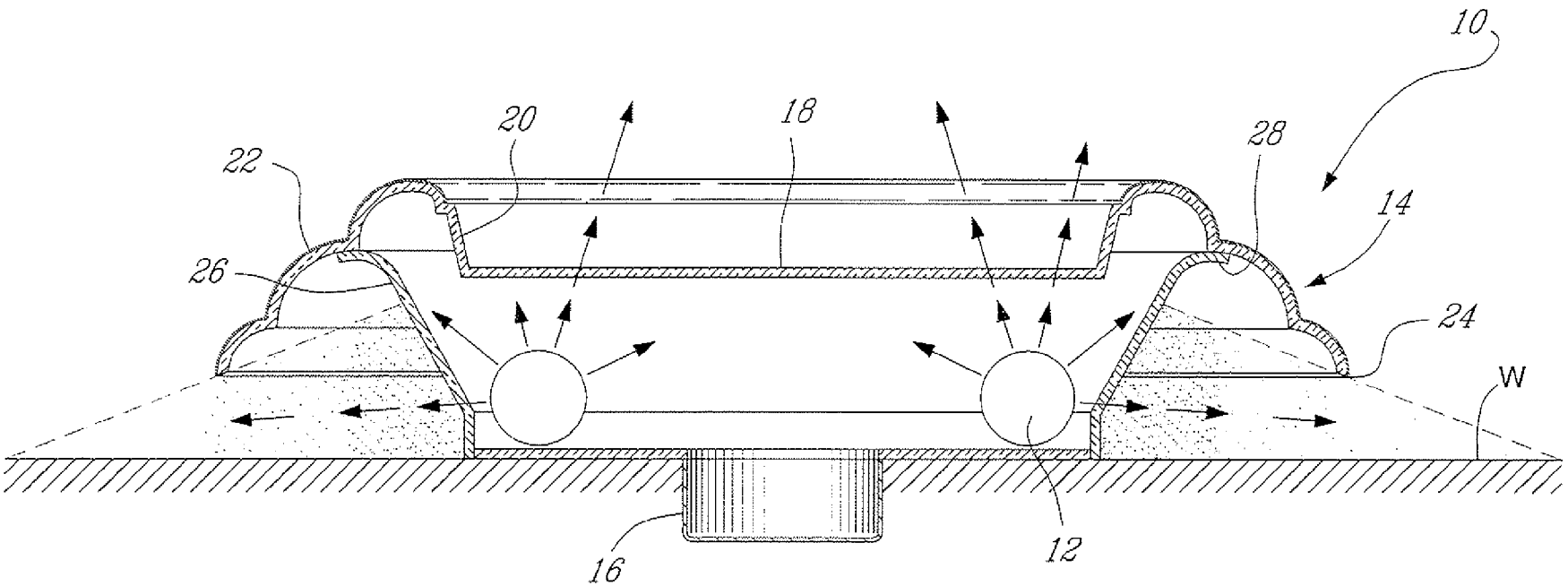
FIG. 2 is a cross-sectional view of the lighted sign shown in FIG. 1.

FIGS. 1 and 2 illustrate an embodiment of a lighted sign 10 comprising a light source 12 received in a sign housing 14 adapted to be mounted to an electrical box 16 mounted to a wall W or the like. Screws, clip, snaps or other suitable attachments (not shown) could be used to removably mount the housing 14 to the electrical box 16. It is understood that the lighted sign 10 could be mounted to a wide variety of surfaces and not only to a wall. For instance, the sign could be free-standing, mounted to a panel or back to back to another similar sign, or even form part of another device or equipment. Other systems could also be mounted to the sign 10. For instance, a clock could be integrated to the housing 14 to form part of the lighted sign 10.

The light source 12 could be powered be any suitable power source. It does not necessarily have to be mounted to an electrical box of a building as shown in FIG. 1. For instance, batteries could be used to power the light source 12 or the light source could be connected to a conventional electric outlet.

The housing 14 comprises a front sign face 18 having a forwardly projecting rim 20. The sign face 18 typically bear a message or indicia, such as an add, an image or a picture, to be displayed. The sign face 18 is at least partly translucent for allowing the light emitted from the internal light source 12 to be transmitted therethrough. Other parts of face 18 could be opaque to block the light from passing through these other parts of the sign face 18. The light from the light source 12 hits face 18 and where the face is light-transmissive, some portion of the light passed through and where the front face is light-blocking, the light is mostly absorbed by the opaque surface. The sign face 18 can have various peripheral shapes. According to the illustrated embodiment, the sign face 18 is circular. Face 18 is surrounded by a skirt 22 extending rearwardly from the rim 20. The skirt is typically opaque. However, it could be only partly opaque. The skirt 22 defines the contour 24 of the housing 14. The contour 24 is herein intended to refer to the outline of the sign housing 12. The contour 24 can be of any desired shape and is at least partly opaque. In the illustrated embodiment, the contour 24 is also circular. The sign face 18 and the skirt 22 are preferably of unitary construction. The unitary sign face 18 and the skirt 22 can be configured to have the general shape of a product that is being advertised. For instance, the housing 14 could have the shape of a bottle cap or the outline of a logo of the product to be advertised.

A light diffuser 26 is mounted behind the skirt 22 to form a translucent sidewall for the housing 14. The light diffuser 26 can be hidden behind an opaque portion of the skirt 22 or be visible therethrough. In the illustrated example, the skirt 22 is entirely opaque and thus the diffuser 26 is not visible from the front side of the housing 14. The light diffuser 26 projects rearwardly outwardly of the skirt 22. Accordingly, when the sign 10 is mounted to the wall W as shown in FIG. 2, the distal end of the skirt 22 defining the contour 24 is spaced from the wall W, thereby providing a gap though which the light can escape from within the housing 14. According to the illustrated embodiment, the diffuser 26 has an outwardly turned lip 28 for facilitating mounting of the diffuser 26 to the back side of the skirt 22. The lip 28 can be glued or otherwise secured to the skirt 22. It is understood that the skirt 22 does not necessarily have to be supported by the light diffuser 26, it could be mounted otherwise. The diffuser 26 is preferably of a distinctive colour.

As shown in FIG. 2, the internal light source is used for both backlighting the sign face 18 and to create an illuminated background for the contour 24, thereby improving the contrast thereof on the wall or surface to which the housing 14 is mounted. The illuminated background or the peripheral glow effect is provided by the light transmitted through the light diffuser 26 outwardly of the border or the outline of the housing 14. The colour of the illuminated background is dictated by the colour of the diffuser 26. To further enhance the visual effect, the colour of the diffuser 26 is different from that of the skirt 22 and the sign face 18. The peripheral illuminated background provides for the shape of the housing (the contour 24) to stand out from the mounting surface. It provides a depth effect or perception.

The unitary sign face 18 and skirt 22 are preferably obtained from an acrylic sheet. It is understood that any other suitable translucide thermoformable, pressable, or injectable material could be used as well. A screen printing or other suitable painting process (e.g. ink jet, spray painting) is used to form the opaque zones and the desired indicia on the sign face 18 and the peripheral skirt 22. Thereafter, the acrylic sheet is thermoformed into the desired shape. Alternatively, a plain translucent sheet of material could be molded into the desired shaped and thereafter spray painted to provide the desired opaque zones.

It is pointed out that the light source 12 can be of any suitable types, such as neon, light emitting diodes (LED), fluorescent, halogen, incandescent. This is not intended to be an exhaustive list. The light source can have a colour or not.

According to a further embodiment of the present invention, lenses, mirrors or other suitable optical elements are mounted to the interior surface of the skirt 24 to redirect a beam of light from the internal light source 12 onto the exterior side of the sign face through the rim portion 20 thereof. This provides for a front lit sign arrangement.

What is claimed is:

1. A lighted sign comprising a front face having at least a translucent portion, a skirt at least partly surrounding said front face and extending rearwardly with respect thereto, the skirt defining a contour of the lighted sign, the contour being at least partly opaque, a light diffuser located behind said skirt, the skirt extending laterally outwardly relative to the light diffuser and defining therewith a rearwardly open gap, and a light source within the lighted sign, the light source lighting both 1) said translucent portion of said front face and 2) the light diffuser, at least a portion of the light transmitted laterally outwardly through the light diffuser coming out rearwardly from the lighted sign through said rearwardly open gap; wherein a rim projects forwardly from a periphery of the front face, thereby providing for a recessed front surface, and wherein said skirt projects integrally rearwardly from said rim.

2. A lighted sign as defined in claim 1, wherein said light diffuser extends rearwardly outwardly of said skirt, and wherein said light diffuser is not visible through said skirt.

3. A lighted sign as defined in claim 1, wherein said light diffuser has a color different than a color of said translucent portion of said front face.

4. A lighted sip as defined in claim 1, wherein the light diffuser is hidden behind an opaque zone of the skin.

5. A lighted sign as defined in claim 1, wherein the skin and the light diffuser have an overlapping area in a depthwise direction, the light diffuser having a rear end portion which extends rearwardly beyond the skin, the light being at least partly blocked in the overlapping area by the skin while being allowed to pass laterally out or the sign through the rear end portion of the light diffuser.

6. A lighted sign comprising a front face having at least a translucent portion, a skirt at least partly surrounding said front face and extending rearwardly with respect thereto, the skirt defining a contour of the lighted sign, the contour being at least partly opaque, a light diffuser located behind said skirt, the skirt extending laterally outwardly relative to the light diffuser and defining therewith a rearwardly open gap, and a light source within the lighted sign, the light source lighting both 1) said translucent portion of said front face and 2) the light diffuser, at least a portion of the light transmitted laterally outwardly through the light diffuser coming out rearwardly from the lighted sign through said rearwardly open gap; wherein a light reflective device is mounted on an internal surface of the skirt and oriented to redirect the light onto an external surface of the front face of the lighted sign through a translucent surface between the front face and the skirt.

7. A lighted sign comprising a housing defining an internal volume for accommodating a light source, said housing having a front face having a main translucent zone surrounded by an opaque zone, the opaque zone defining the outline of the sign, and a sidewall disposed inboard of said outline and extending rearwardly from said front face, said sidewall having a rear translucent portion through which light from said light source can pass, and a skirt surrounding said sidewall and defining therewith a rearwardly open gap to allow the light passing through the rear translucent portion of the sidewall to come out rearwardly of the lighted sign to provide a contrasting illuminated background for said outline of the sign; wherein a rim projects forwardly from a periphery of the front face, thereby providing for a recessed front surface, and wherein said skirt projects integrally rearwardly from said rim.

8. A lighted sign as defined in claim 7, wherein said front face has a front panel having a peripheral rearwardly skirt, the outline being defined by said skirt, and wherein said rear translucent portion of said sidewall extends rearwardly beyond said skirt, said sidewall being hidden behind said skirt from a front point of view.

9. A lighted sign as defined in claim 8, wherein the skirt and the sidewall have an overlapping area in a depthwise direction, the sidewall having a rear end portion which extends rearwardly beyond the skirt, the light being at least partly blocked in the overlapping area by the skirt while being allowed to pass laterally out of the sign through the rear end portion of the sidewall.

* * * * *